US006703429B2

(12) United States Patent
O'Rear et al.

(10) Patent No.: US 6,703,429 B2
(45) Date of Patent: Mar. 9, 2004

(54) PROCESS FOR CONVERTING SYNTHESIS GAS INTO HYDROCARBONACEOUS PRODUCTS

(75) Inventors: Dennis J. O'Rear, Petaluma, CA (US); Charles L. Kibby, Benicia, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 292 days.

(21) Appl. No.: 09/938,069

(22) Filed: Aug. 23, 2001

(65) Prior Publication Data

US 2003/0045591 A1 Mar. 6, 2003

(51) Int. Cl.[7] ..... C07C 27/00; C07C 1/00

(52) U.S. Cl. ..... 518/706; 518/700; 518/714; 518/715; 585/310; 585/322; 585/323

(58) Field of Search ..... 518/700, 706, 518/714, 715; 585/310, 322, 323

(56) References Cited

U.S. PATENT DOCUMENTS

| | | | |
|---|---|---|---|
| 3,972,958 | A | 8/1976 | Garwood et al. |
| 4,048,250 | A | 9/1977 | Garwood et al. |

(List continued on next page.)

FOREIGN PATENT DOCUMENTS

| | | | |
|---|---|---|---|
| DE | 2438251 | A1 | 2/1975 |
| DE | 2912067 | A1 | 11/1979 |
| DE | 2846693 | A1 | 5/1980 |
| DE | 2947931 | A1 | 6/1980 |
| DE | 4238640 | A1 | 6/1993 |
| EP | 0068603 | A2 | 1/1983 |
| EP | 0120510 | A1 | 10/1984 |
| EP | 0124999 | A2 | 11/1984 |
| EP | 0153517 | A1 | 9/1985 |
| EP | 0154063 | A1 | 9/1985 |
| EP | 0318282 | A2 | 5/1989 |
| EP | 0512635 | A2 | 11/1992 |
| EP | 0609079 | A1 | 8/1994 |
| EP | 1010683 | A1 | 6/2000 |
| FR | 2573998 | A1 | 6/1986 |
| GB | 2097382 | A | 11/1982 |
| JP | 59-175443 | | 3/1983 |
| NL | 7711350 | | 4/1979 |
| WO | WO92/11223 | A1 | 7/1992 |
| WO | WO94/04476 | A1 | 3/1994 |
| WO | WO97/28108 | A1 | 8/1997 |

OTHER PUBLICATIONS

Chang, C.D., et al., *Syngas Conversion to Ethane over Metal–Zeolite Catalysts, Journal of Catalysis*, vol. 90, No. 1, Nov., 1984, pp. 84–87, Academic Press, Inc. New York.

Chang, C.D., et al., *Synthesis Gas Conversion to Aromatic Hydrocarbons, Journal of Catalysis*, vol. 56, No. 2, Feb., 1979, pp. 268–273, Academic Press, Inc. New York.

(List continued on next page.)

*Primary Examiner*—J. Parsa
(74) *Attorney, Agent, or Firm*—Burns, Doane, Swecker & Mathis, L.L.P.

(57) ABSTRACT

The present invention discloses a process for converting synthesis gas into hydrocarbonaceous products including the steps of: (a) subjecting a first portion of synthesis gas to a dual functional syngas conversion process to form a first effluent comprising a first hydrocarbonaceous product including aromatics and iso-paraffins; (b) subjecting a second portion of synthesis gas to a Fischer-Tropsch synthesis process to form a second effluent comprising a second hydrocarbonaceous product including linear paraffins and linear olefins; and (c) alkylating the linear olefins with the iso-paraffins to produce high octane gasoline range alkylate.

38 Claims, 1 Drawing Sheet

U.S. PATENT DOCUMENTS

| | | | |
|---|---|---|---|
| 4,049,734 | A | 9/1977 | Garwood et al. |
| 4,076,761 | A | 2/1978 | Chang et al. |
| 4,086,262 | A | 4/1978 | Chang et al. |
| 4,096,163 | A | 6/1978 | Chang et al. |
| 4,139,550 | A | 2/1979 | Seitzer |
| 4,218,388 | A | 8/1980 | Schaper et al. |
| 4,279,830 | A | 7/1981 | Haag et al. |
| 4,418,154 | A | 11/1983 | McCandlish et al. |
| 4,556,645 | A | 12/1985 | Coughlin et al. |
| 4,559,316 | A | 12/1985 | Mazanec et al. |
| 4,568,663 | A | 2/1986 | Mauldin |
| 4,568,698 | A | 2/1986 | Desmond et al. |
| 4,795,853 | A | 1/1989 | Miller et al. |
| 5,489,728 | A | 2/1996 | Benazzi et al. |
| 6,137,021 | A | 10/2000 | Eshelman et al. |
| 6,194,625 | B1 | 2/2001 | Graves et al. |

OTHER PUBLICATIONS

Comelli, R.A., et al., *Synthesis of Hydrocarbons from Syngas Using Mixed Zn–Cr Oxides: Amorphous Silica–Alumina Catalysts, Industrial & Engineering Chemistry Research: Kinetic Catalysis, and Reaction Engineering*, vol. 32, No. 11, Nov., 1993, pp2474–2477, Published by American Chemical Society, Washington, DC.

De Lasa, H., et al., *Compound Catalyst for High Yields of Olefins from Synthesis Gas: Catalytic Reaction Steps, Chemical Engineering Science*, vol. 51, No. 11, 1996, pp. 2885–2890, Elsevier Science LTD, Great Britain.

Denise, B., et al., *Hydrocondensation of Carbon Monoxide on Composite Bifunctional Catalysts, 8th International Congress on Catalysis*, 1984, pp. 93–100 Dechema, Schön & Wetzel, Germany.

Ereña, J., et al., *Study of Physical Mixtures of $Cr_2O_3$–ZnO and ZSM–5 Catalysis for the Transformation of Syngas into Liquid Hydrocarbons, Industrial & Engineering Chemistry Research: Kinetics Catalysis, and Reaction Engineering*, vol. 37, No. 4, Apr. 1998, pp. 1211–1219, Published by American Chemical Society, Washington, DC.

Erkey, C., et al., *Isobutylene Production from Synthesis Gas over Zirconia in a Slurry Reactor, Industrial & Engineering Chemistry Research: Kinetics Catalysis, and Reaction Engineering*, vol. 34, No. 4, Apr. 1995, pp. 1021–1026, Published by American Chemical Society, Washington, DC.

Feng, Z., et al., *Selective Formation of Isobutane and Isobutene from Synthesis Gas over Zirconia Catalysts Prepared by a Modified Sol–Gel Method, Journal of Catalysis*, vol. 148, No. 1, Jul. 1994, pp. 84–90, Academic Press, Inc. Harcourt Brace & Company, New York.

Fujimoto, K., et al., *Synthesis Gas Conversion Utilizing Mixed Catalyst Composed of CO Reducing Catalyst and Solid Acid, Journal of Catalysis*, vol. 87, No. 1, May 1984, pp. 136–143, Academic Press, Inc. New York.

Fujiwara, M., et al., *Change of catalytic properties of FE–ZnO/zeolite composite catalyst in the hydrogenation of carbon dioxide, Applied Catalysis A: General*, 154, 1997, pp. 87–101, Elsevier Science B.V.

Fujiwara, M., et al., *Development of composite catalysts made of Cu–Zn–Cr oxide/zeolite for the hydrogenation of carbon dioxide, Applied Catalysis A: General*, 121, 1995, pp. 113–124, Elsevier Science B.V.

Fujiwara, M., et al., *Hydrogenation of carbon dioxide over Cu–Zn–chromate/zeolite composite catalyst: The effects of reaction behavior of alkenes on hydrocarbon synthesis, Applied Catalysis A: General*, 30, 1995, pp. 105–116, Elsevier Science B.V.

Hagiwara, H., et al., *Conversion of Synthesis Gas to Light Olefins Utilizing ZSM–5 Type Zeolite Catalysts Modified with Alkaline Earth Metals, Journal of the Japan Petroleum Institute: Sekiyu Gakkaishi*, vol. 29, No. 2 1986, pp. 174–177.

Inui, T., et al., *Hydrogenation of carbon dioxide to $C_1$–$C_7$ hydrocarbons via methanol on composite catalysts, Applied Catalysis A: General*, 94, 1993, pp. 31–44, Elsevier Science B.V.

Inui, T., et al., *Low Temperature Synthesis of Liquid Hydrocarbons from Syngas on Composite Catalysts of Pd–doped Cu–Cr–Zn Mixed Oxides and an H–ZSM–5 Zeolite, Journal of the Japan Petroleum Institute: Sekiyu Gakkaishi*, vol. 28, No. 3 1985, pp. 225–233.

Inui, T., et al., *Selective Gasoline Synthesis from $CO_2$ on a Highly Active Methanol Synthesis Catalyst and an H–Fe–Silicate of MFI Structure, Proceedings of the 10th International Catalysis*, Budapest Jul. 19–24, 1992 pp. 1453–1466, Elsevier Science Publishers B.V.

Ione, K.G., *Some Principles of Polyfunctional Action of Zeolite Catalysis, Kinetics and Catalysis*, vol. 21, No. 5, Part 2, Sep.–Oct. 1980, translated from Russian in Apr. 1981, pp. 881–890, Plenium Publishing Corporation, Jamaica, New York.

Ivanova, A.S., et al., *Effect of the Hydrogenating Component of Bifunctional Zeolite–Containing Catalysts on the Composition of the Hydrogenation Products of Carbon Monoxide, Kinetics and Catalysis*, vol. 26, No. 2, Part 1, Mar.–Apr. 1985, translated from Russian in Sep. 1985, pp. 268–273, Plenum Publishing Corporation, Jamaica, New York.

Jeon, J.K., et al., *Selective synthesis of $C_3$–$C_4$ hydrocarbons through carbon dioxide hydrogenation on hybrid catalysts composed of a methanol synthesis catalyst and SAPO, Applied Catalysis A: General*, 124, 1995, pp. 91–106, Elsevier Science B.V.

Kieffer, R., et al., *Hydrogenation of CO and $CO_2$ toward methanol, alcohols and hydrocarbons on promoted copper–rare earth oxides catalysts, catalysis Today*, 36, 1997, pp. 15–24, Elsevier Science B.V.

Miller, J.T., et al., *Isoparaffin Synthesis: Hydrogenation of Carbon Monoxide over Cadmium Catalysts, Journal of Catalysis*, vol. 103, No. 2, Feb. 1987, pp. 512–519, Academic Press, Inc., Duluth, MN.

Mysov, V.M., et al., *Investigation of the processes of organic products synthesis from natural gas via syngas, Natural Gas Conversion V: Studies in Surface Science and Catalysis*, vol. 119, 1998, pp. 533–538, Elsevier Science B.V.

Park, Y.K., et al., *Hydrocarbon synthesis through $CO_2$ hydrogenation over $CuZnOZrO_2$/zeolite hybrid catalysts, Catalysis Today*, 44, 1998, pp. 165–173, Elsevier Science B.V.

Pichler, H., et al., *The Isosynthesis*, Bulletin 488: Bureau of Mines, Department of the Interior, 1950, U.S. Government Printing Office, Washington, D.C.

Postula, W.S., et al., *Conversion of Synthesis Gas to Isobutylene over Zirconium Dioxide Based Catalysts, Journal of Catalysis*, vol. 145, No. 1, Jan. 1994, pp. 126–131, Academic Press, Inc., New York.

Postula, W.S., et al., *Effect of hydrogen sulfide on isosynthesis over 7 wt.–*
cerium zirconia catalyst, Applied Catalysis A: General, 112, 1994, pp. 175–185, Elsevier Science B.V.
Shah, Y.T., et al., *Catalysts for Fischer–Tropsch and Isosynthesis, Industrial & Engineering Chemistry Product Research and Development: IEPRA6, Product R& D*, vol. 15, No. 2, Jun. 1976, American Chemical Society, Washington, D.C.
Simard, F., et al., *ZnO–$Cr_2O_2$+ZSM–5 catalyst with very low Zn/Cr ratio for the transformation of synthesis gas to hydrocarbons, Applied Catalysis A: General*, 125, 1995, pp. 81–98, Elsevier Science B.V.
Simard, F., et al., *Pseudoadiabatic Catalytic Reactor Operation for the Conversion of Synthesis Gas into Hydrocarbons (Gasoline Range), Industrial & Engineering Chemistry Product Research*, vol. 30, No. 7, Jul. 1991, pp. 1448–1455, American Chemical Society, Washington, D.C.
Souma, Y., et al., *Hydrocarbon synthesis from $CO_2$ over composite catalysts, Studies in Surface Science and Catalysis*, vol. 114, 1998, pp. 327–332, Elsevier Science B.V.
Tan, Y., et al., *Syntheses of Isobutane and Branched Higher Hydrocarbons from Carbon Dioxide and Hydrogen over Composite Catalysts, Industrial & Engineering Chemistry Research*, vol. 38, No. 9, Sep. 1999, pp. 3225–3229, American Chemical Society, Washington D.C.

Xu, Q., et al., *Hydrogenation of carbon dioxide over Fe–Cu–Na/zeolite composite catalysts, Studies in the Surface Science and Catalysis*, vol 114, 1998, Elsevier Science B.V.

Albright, Lyle, $H_2SO_4$, *HF Process compared, and new technologies revealed, Oil and Gas Journal*, vol. 88, No. 48, Nov. 26, 1990, published by PennWell Publishing Co., 1421 S. Sheridan Rd., Tulsa, OK, 74101, pp. 70–77.

Pines, Herman, *Saga of a discovery: Alkylation, Chemtech*, vol. 12, No. 3, Mar. 1982, published by American Chemical Society, $20^{th}$ & Northampton Streets. Easton, PA., 18042, pp. 150–154.

PROCESS FOR CONVERTING SYNTHESIS GAS INTO HYDROCARBONACEOUS PRODUCTS

FIELD OF THE INVENTION

The present invention relates to a process for producing hydrocarbonaceous products from synthesis gas.

BACKGROUND OF THE INVENTION

Various processes for converting synthesis gas into hydrocarbonaceous products are well known. For example, Fischer-Tropsch synthesis is a well known method for the conversion of remote natural gas into salable products such as liquefied petroleum gas (LPG), condensate, naphtha, jet fuel, diesel fuel, other distillate fuels, lube base stock, and lube base stock feedstock. The Fischer-Tropsch synthesis process produces products that are predominantly linear hydrocarbons. These linear hydrocarbons are desirable for use in distillate fuels and as a lube base stock feedstock because they do not contain cyclic hydrocarbons. The linear structure of the hydrocarbons give them excellent burning properties when used as fuels and a high viscosity index when used as a lube base stock. The non-paraffinic linear hydrocarbons produced from the Fischer-Tropsch synthesis (e.g., olefins and alcohols) can be converted into linear paraffins by hydrogenation (e.g., hydrotreating, hydrofinishing, and/or hydrocracking).

The products from the Fischer-Tropsch process are not ideal, however, for use as a gasoline blend stock or in petrochemical operations. These uses require the presence of either aromatics or highly branched iso-paraffins, the production of which requires the use of naphtha reforming and/or alkylation processes. The low molecular weight products of the Fischer-Tropsch process that are rich in linear olefins could be converted to high octane alkylate if a source of iso-butane were available. Although iso-butane could be made from a conventional Fischer-Tropsch process by saturation of a butane stream followed by isomerization, the process would be expensive.

Another process for converting synthesis gas into hydrocarbonaceous products is the dual functional syngas conversion process. This process was developed from Isosynthesis, a process developed in Germany in the 1930's with the objective of making low molecular weight iso-paraffins using Thoria catalysts at high pressures. More recently, Isosynthesis has evolved to use at least two different types of catalysts that both make methanol and consume it. Iso-paraffins are again a major component of the product, and this dual functional syngas conversion process can also be referred to as modern Isosynthesis. The products from the modern dual functional syngas conversion reactor are a mixture of low molecular weight iso-paraffins and an aromatic-rich product.

However, the dual functional syngas conversion process does not make products that can readily be converted into jet fuel, diesel fuel, other distillate fuels, lube base stock, or lube base stock feedstock. Light gases produced by the dual functional syngas conversion process are rich in iso-butane, but it is not easy to convert this product into fuels because to do so would require the process steps of dehydrogenation, oligomerization, and alkylation.

Accordingly, there is a need in the art for an economic and efficient process for converting synthesis gas into a full range of hydrocarbonaceous products.

SUMMARY OF THE INVENTION

The present invention relates to processes for converting synthesis gas into hydrocarbonaceous products. In one aspect of the present invention, a process for converting synthesis gas into hydrocarbonaceous products is provided comprising the steps of (a) subjecting a first portion of synthesis gas to a dual functional syngas conversion process to form a first effluent comprising a first hydrocarbonaceous product including aromatics and iso-paraffins; (b) subjecting a second portion of synthesis gas to a Fischer-Tropsch synthesis process to form a second effluent comprising a second hydrocarbonaceous product including linear paraffins and linear olefins; and (c) alkylating the linear olefins with the iso-paraffins to produce high octane gasoline range alkylate.

In another aspect of the invention, a process for converting synthesis gas into hydrocarbonaceous products is provided comprising the steps of (a) providing a synthesis gas; (b) subjecting at least a portion of the synthesis gas to a dual functional syngas conversion process to form a first effluent comprising unreacted synthesis gas and a first hydrocarbonaceous product including aromatics and iso-paraffins; (c) subjecting the unreacted synthesis gas to a Fischer-Tropsch synthesis process to form a second effluent comprising a second hydrocarbonaceous product including linear paraffins and linear olefins; and (d) alkylating the linear olefins with at least a portion of the iso-paraffins to produce high octane gasoline range alkylate.

In a further aspect of the present invention, a process for converting synthesis gas into hydrocarbonaceous products is provided that comprises the steps of (a) providing a synthesis gas; (b) subjecting at least a portion of the synthesis gas to a dual functional syngas conversion process to form a first effluent comprising a first portion of unreacted synthesis gas, carbon dioxide, a first portion of water, and a first hydrocarbonaceous product including aromatics and iso-butane; (c) separating the first hydrocarbonaceous product into a light gas fraction, an iso-butane-containing stream, and a high octane aromatic gasoline blend component; (d) subjecting the unreacted synthesis gas to a Fischer-Tropsch synthesis process to form a second effluent comprising a second portion of water, a second portion of unreacted synthesis gas, and a second hydrocarbonaceous product including linear paraffins and linear olefins; (e) separating the second hydrocarbonaceous product into a light gas stream, a $C_3$–$C_4$ olefin-containing stream, a $C_3$–$C_4$ alcohol-containing stream, and a $C_5^+$ stream; (f) combining the $C_3$–$C_4$ olefin-containing stream and the $C_3$–$C_4$ alcohol-containing stream to form a combined stream; (g) reducing the oxygen content of the combined stream to below 4000 ppm by dehydration; and (h) alkylating the combined stream with the iso-butane-containing stream to produce high octane iso-paraffinic gasoline range alkylate.

Unless otherwise stated, the following terms used in the specification and claims have the means given below:

"Aromatic" means a molecular species that contains at least one aromatic function.

"Jet fuel" means a material suitable for use in turbine engines for aircraft or other uses meeting the current version of at least one of the following specifications:

ASTM D1655-99

DEF STAN 91-91/3 (DERD 2494), TURBINE FUEL, AVIATION, KEROSINE TYPE, JET A-1, NATO CODE: F-35

International Air Transportation Association (IATA) "Guidance Material for Aviation Turbine Fuels Specifications", 4th edition, March 2000

United States Military Jet fuel specifications MIL-DTL-5624 (for JP-4 and JP-5) and MIL-DTL-83133 (for JP-8)

"Diesel fuel" means a material suitable for use in diesel engines and conforming to the current version at least one of the following specifications:

ASTM D 975—"Standard Specification for Diesel Fuel Oils"

European Grade CEN 90

Japanese Fuel Standards JIS K 2204

The United States National Conference on Weights and Measures (NCWM) 1997 guidelines for premium diesel fuel The United States Engine Manufacturers Association recommended guideline for premium diesel fuel (FQP-1A)

"Gasoline" means a material suitable for use in spark-ignition internal-combustion engines for automobiles and light trucks (motor gasoline) and in piston engine aircraft (aviation gasoline) meeting the current version of at least one of the following specifications:

ASTM D4814 for motor gasoline

European Standard EN 228 for motor gasoline

Japanese Standard JIS K2202 for motor gasoline

ASTM D910 for aviation gasoline

ASTM D6227 "Standard Specification for Grade 82 Unleaded Aviation Gasoline".

UK Ministry of Defense Standard 91-90/Issue 1 (DERD 2485), GASOLINE, AVIATION: GRADES 80/87, 100/130 and 100/130 LOW LEAD "Distillate fuel" means a material containing hydrocarbons with boiling points between approximately 60° F. to 1100° F. The term "distillate" means that typical fuels of this type can be generated from vapor overhead streams from distilling petroleum crude. In contrast, residual fuels cannot be generated from vapor overhead streams by distilling petroleum crude, and are then non-vaporizable remaining portion. Within the broad category of distillate fuels are specific fuels that include: naphtha, jet fuel, diesel fuel, kerosene, aviation gas, fuel oil, and blends thereof.

"Lube base stock" means a material having a viscosity greater than or equal to 3 cSt at 40° C., a pour point below 20° C. preferably at or below 0° C., and a VI greater than 70, preferably greater than 90. It is optionally used with additives, and/or other base stocks, to make a finished lubricant. The finished lubricants can be used in passenger car motor oils, industrial oils, and other applications. When used for passenger car motor oils, base stocks meet the definitions of the current version of API Base Oil Interchange Guidelines 1509.

"Naphtha" means a light hydrocarbon fraction composed of $C_5$–$C_9$ hydrocarbonaceous compounds used in the production of gasoline, solvents, and as a feedstock for ethylene.

"Iso-paraffin" means a non-cyclic and non-linear paraffin with the formula $C_nH_{2n+2}$.

"Synthesis gas" or "syngas" means a gaseous mixture of hydrogen and carbon monoxide, and may also contain one or more of water, carbon dioxide, unconverted light hydrocarbon feedstock, and various impurities such as sulfur or sulfur compounds and nitrogen. The synthesis gas or gases used in the present invention may be derived from a variety of sources such as, for example, methane, light hydrocarbons, coal, petroleum products, or combinations thereof. Such sources can be used to generate synthesis gas through processes such as, for example, steam reforming, partial oxidation, gasification purification of synthesis gas, and combinations of these processes. More specific examples of processes for generating synthesis gas include the reforming of methane or the gasification of coal or petroleum products such as resid.

"Hydrocarbonaceous" means containing hydrogen and carbon atoms and potentially also containing heteroatoms such as oxygen, sulfur, or nitrogen.

"Full range of hydrocarbonaceous products" means a range of hydrocarbonaceous products including, but not limited to, high octane blend streams, jet fuel, diesel fuel, other distillate fuels, lube base stock, and lube base stock feedstock.

"High octane gasoline range alkylate" is a product of an alkylation process having high octane.

"High octane aromatic gasoline" means a Gasoline with a high octane containing greater than 25 wt % aromatics preferably greater than 50 wt % aromatics. "High octane gasoline blend" or "high octane gasoline blend component" means is a material that has greater than 85 octane by the research octane method, preferably greater than or equal to 90, most preferably greater than or equal to 95. Research Octane Numbers are measured by ASTM D2699 "Standard Test Method for Research Octane Number of Spark-Ignition Engine Fuels"

DETAILED DESCRIPTION OF ILLUSTRATIVE EMBODIMENTS

Figure 1:
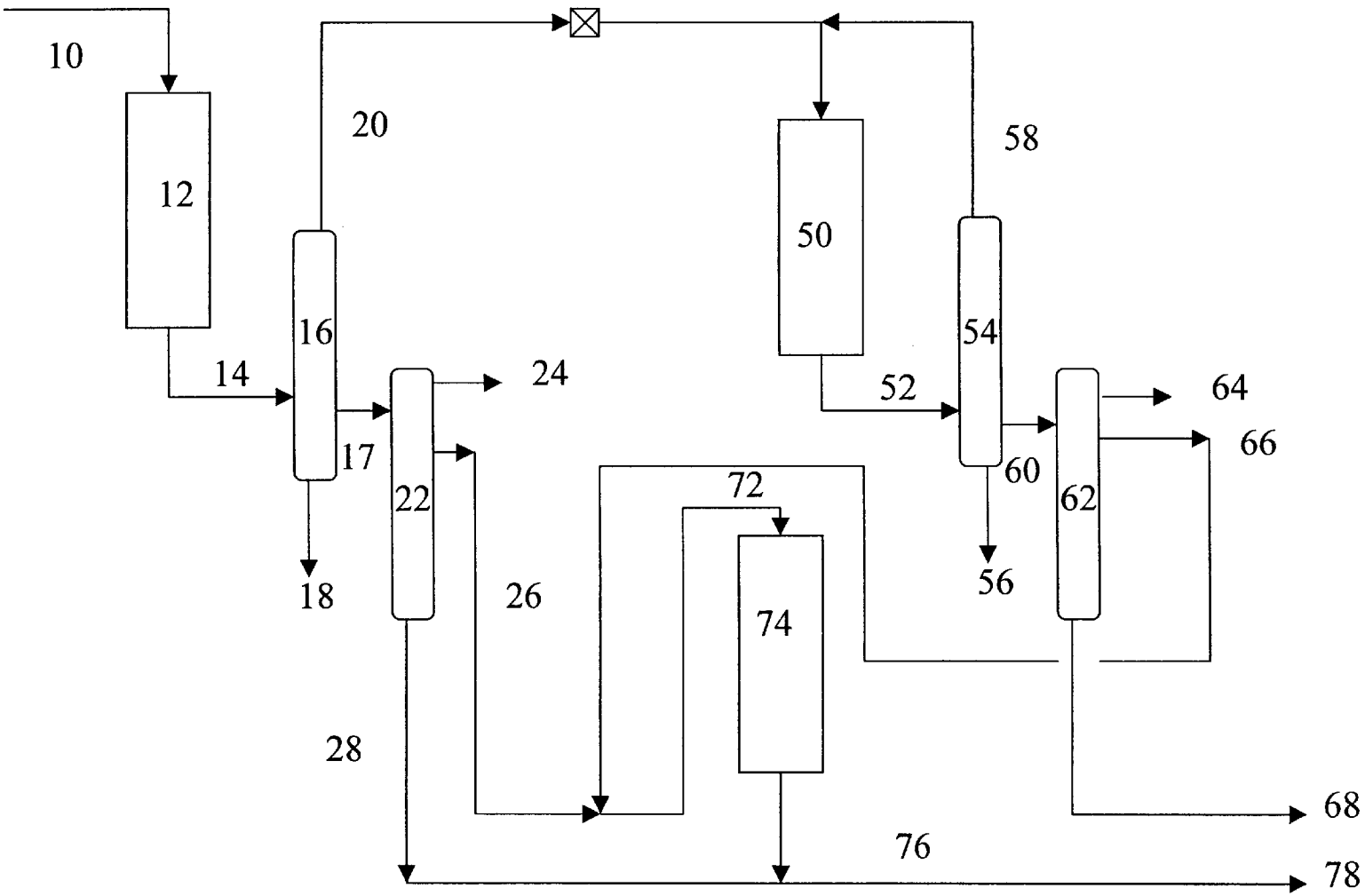
FIG. 1 illustrates a process for converting synthesis gas into hydrocarbonaceous products according to one embodiment of the present invention.

According to the present invention, a process is provided for converting synthesis gas into hydrocarbonaceous products by utilizing a dual functional syngas conversion process and a Fischer-Tropsch synthesis process. The present invention can produce a full range of hydrocarbonaceous products that are typically not produced when using either Fischer-Tropsch synthesis or dual functional syngas conversion by themselves.

The process of the present invention involves providing a synthesis gas or gases, subjecting a first portion of synthesis gas to a dual functional syngas conversion process, and subjecting a second portion of synthesis gas to a Fischer-Tropsch synthesis process. Linear olefins produced in the dual functional syngas conversion process are alkylated with iso-paraffins produced in the Fischer-Tropsch synthesis process to form high octane gasoline range alkylate. Other products that may be produced by the present invention include high octane aromatic gasoline, high octane gasoline blend streams, jet fuel, diesel fuel, other distillate fuels, lube base stock, and lube base stock feedstock. The dual functional syngas conversion process and the Fischer-Tropsch synthesis process may be operated in parallel (i.e., side by side) or in series to produce the desired products and are discussed in more detail below.

The dual functional syngas conversion process and the Fischer-Tropsch synthesis process may be operated using the same source of synthesis gas or separate sources of synthesis gas. The composition of the synthesis gas for the dual functional syngas conversion process and Fischer-Tropsch synthesis process can be, but does not need to be, the same. If a common source of synthesis gas is used as a feed stream, and different CO to $H_2$ ratios are desired, the ratio of one or both of the streams can be adjusted by adding or removing CO or $H_2$ or by conducting water gas shift or reverse water gas shift reactions. The tailoring of the synthesis gas composition can also be done between the stages when the two processes are operated in series. If desired, water can be either added or removed from the synthesis gas prior to processing in the Fischer-Tropsch and/or the dual functional syngas conversion reactors.

Dual functional syngas conversion (or "modern Isosynthesis") is a process for the conversion of syngas to higher molecular weight products via a methanol intermediate. The process uses at least two different types of catalysts and involves making a methanol intermediate over one catalyst followed by the rapid consumption of that intermediate over a second catalyst while the reaction mixture remains in the same reactor. The products of the dual functional syngas conversion process can include olefins (such as ethylene), aromatics, iso-paraffins, with smaller amounts of cycloparaffins (from hydrogenation of aromatics) and C5- normal n-paraffins (mostly propane) and combinations thereof. The presence of methanol is difficult to detect in the products since it is a reactive intermediate and is typically consumed as rapidly as it is made.

Common methanol synthesis catalysts include the metals or oxides of zinc, iron, cobalt, nickel, ruthenium, thorium, rhodium and/or osmium and can also include chromia, copper, alumina, and modifications thereof. Preferred catalysts for converting syngas to methanol may include one or more transition metals and typically include at least copper, chromium, alumina, or zinc.

Catalysts useful for converting methanol to aromatics and iso-paraffins typically include one or more zeolites and/or non-zeolitic molecular sieves and the catalyst may be a strong solid acid. Those zeolites which are relatively acidic tend to produce more aromatics, and those which are relatively non-acidic tend to form more iso-paraffins.

When the dual functional syngas conversion catalyst includes a zeolite in addition to the methanol synthesis component, the properties of the zeolite determine the nature of the product of the reaction. When the zeolite becomes acidic, hydrogen transfer occurs. Hydrogen transfer converts some of the higher molecular weight growing hydrocarbon fragments into aromatics. The hydrogen from this reaction is not released into the gas phase as molecular $H_2$, but rather shuttles to lower molecular weight olefins. These lower molecular weight olefins are converted into less valuable LPG. In addition, the hydrogen from the aromatics can reduce CO to methane. Therefore, the products from a dual functional syngas conversion process using an acidic catalyst include an aromatic-rich gasoline and light gases. The production of the less valuable light gases negates the production of the more valuable gasoline (or petrochemical grade aromatics).

If the acidity of the zeolite is reduced, however, hydrogen transfer is reduced and the hydrocarbons continue to grow into the jet and diesel range rather than being converted to aromatics. Also, since hydrogen transfer is reduced, the production of light gases is reduced. Previous studies have demonstrated that if the acidity of the zeolite is reduced, gas production is reduced, product aromatics are reduced, and a very high proportion of iso-paraffins are produced.

Process conditions for the dual functional syngas conversion process are summarized in the following table.

| Variable | Broad | Preferred |
|---|---|---|
| Pressure, Atmospheres | 25–100 | 35–75 |
| Temperature, ° C. | 300–500 | 375–425 |
| CO conversion, % | 20–80 | 30–50 |
| H2/CO ratio | 1.25–3.0 | 1.5–1.75 |

Any reaction vessel that is capable of being used to conduct a plurality of simultaneous reactions using gas phase reactants and solid catalysts under conditions of elevated temperature and pressure can be used. Such reaction vessels are well known to those skilled in the art. The preferred reaction vessel is a fixed bed catalyst system equipped with facilities to remove heat, such as introduction of cooled synthesis gas at different points in the reactor or with steam-generation coils.

According to the present invention, the dual functional syngas conversion process and the Fischer-Tropsch synthesis process described below may occur in parallel or in series. Preferably, the dual functional syngas conversion process and the Fischer-Tropsch synthesis process operate in series, most preferably with the dual functional syngas conversion process occurring first.

There are several advantages to performing the dual functional syngas conversion process first. The dual functional syngas conversion process is typically operated at a higher pressure and temperature than the Fischer-Tropsch synthesis process, and performing the dual functional syngas conversion process first eliminates the need for compression and heating before the Fischer-Tropsch process. In addition, the catalysts used in the dual functional syngas conversion process are not poisoned by sulfur, but can act to adsorb it. In comparison, the catalyst in the Fischer-Tropsch synthesis process is very susceptible to sulfur poisoning and performing the dual functional syngas conversion process first provides some measure of protection to the Fischer-Tropsch catalyst.

In the present invention, a first portion of synthesis gas is subjected to a dual functional syngas conversion process in a dual functional syngas conversion reactor or reaction zone to form an effluent comprising a first hydrocarbonaceous product. The dual functional syngas conversion process is preferably conducted with an appropriate catalyst and under appropriate process conditions to produce a hydrocarbonaceous product including aromatics and iso-paraffins with few linear hydrocarbons. The linear C4+ hydrocarbon content of the product from the Isosynthesis reactor will be less than 20% most commonly less than 10%. The hydrocarbonaceous product preferably includes high octane aromatic gasoline and low molecular weight iso-paraffins that include iso-butane. The hydrocarbonaceous product preferably contains between 5 and 35% w/w of aromatics, more preferably between 15 and 30% w/w aromatics. The aromatics contained in the hydrocarbonaceous product are principally $C_7$–$C_9$ aromatics, with lesser amounts of $C_6$ and $C_{10}$ aromatics.

Methane yields are typically low, below 10 wt %, preferably below 5%, and most preferably below 2 wt %. In comparison, methane yields from the FT step are most often relatively higher. Methane is generally an undesired or less valuable product in comparison to others, and use of Isosynthesis provides a way to minimize its production.

As discussed more fully below, the iso-butane that is produced from the dual functional syngas conversion reactor is used to alkylate linear olefins produced in the Fischer-Tropsch synthesis process to form valuable high octane gasoline range alkylate. This alkylate may be combined with the high octane aromatic gasoline made from the dual functional syngas conversion reactor to form a high octane gasoline blend component.

When the dual functional syngas conversion process is performed first, the effluent preferably includes an unreacted portion of synthesis gas which may be used in the subsequent Fischer-Tropsch synthesis process. The hydrocarbonaceous products from the dual functional syngas conversion reactor may be separated from the unreacted synthesis gas prior to passing the synthesis gas to the Fischer-Tropsch reactor or the entire effluent can be fed to the Fischer-Tropsch reactor.

In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of about from 300 to 700° F. (149° to 371° C.) preferably about from 400° to 550° F. (204° to 228° C.); pressures of about from 10 to 600 psia (0.7 to 41 bars), preferably 30 to 300 psia (2 to 21 bars); and catalyst space velocities of about from 100 to 10,000 cc/g/hr., preferably 300 to 3,000 cc/g/hr.

The products may range from $C_1$ to $C_{200+}$ with a majority in the $C_5$–$C_{100+}$ range. The reaction can be conducted in a variety of reactor types for example, fixed bed reactors containing one or more catalyst beds, slurry reactors, fluidized bed reactors, or a combination of different type reactors. Such reaction processes and reactors are well known and documented in the literature. Slurry Fischer-Tropsch processes utilize superior heat (and mass) transfer characteristics for the strongly exothermic synthesis reaction and are able to produce relatively high molecular weight, paraffinic hydrocarbons when using a cobalt catalyst.

In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP0609079, completely incorporated herein by reference for all purposes.

Suitable Fischer-Tropsch catalysts comprise one or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg, and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known, and illustrative but nonlimiting examples may be found, for example, in U.S. Pat. No. 4,568,663.

The Fischer-Tropsch synthesis is a well known method for the production of products such as LPG ($C_3$ and $C_4$), condensate ($C_5$ and $C_6$), naphtha ($C_5$ to $C_9$), jet fuel, diesel fuel, other distillate fuels, lube base stock, and lube base stock feedstock. The products of the Fischer-Tropsch synthesis process are predominantly linear hydrocarbons and include linear paraffins with smaller amounts of linear olefins and linear alcohols, and even smaller amounts of linear acids and other compounds.

In the present invention, a second portion of synthesis gas is subjected to a Fischer-Tropsch synthesis process in a Fischer-Tropsch reactor or reaction zone to form a second effluent comprising a second hydrocarbonaceous product. The Fischer-Tropsch synthesis process is preferably conducted with an appropriate catalyst and under appropriate process conditions to produce a second hydrocarbonaceous product including linear paraffins and linear olefins. The linear olefins are preferably olefins in the range of $C_3$–$C_5$ (propylene, 1-butene, and 1-pentene). The second hydrocarbonaceous product preferably includes a $C_{10}$+ range material comprising greater than 70% paraffins, and the second hydrocarbonaceous product may include linear alcohols, linear acids, and naphtha.

When naphtha is made in the Fischer-Tropsch reactor, it is predominantly composed of linear hydrocarbons and only a relatively small amount is produced. The naphtha can be used as an ethylene cracker feed or converted to an improved gasoline blend component by use of isomerization and/or naphtha reforming. Preferably, the naphtha stream is hydrogenated to remove oxygenates and olefins prior to processing in an ethylene cracker, isomerizer, or naphtha reformer.

The $C_3$–$C_5$ olefins that are produced from the Fischer-Tropsch reactor can be alkylated with the iso-paraffins such as iso-butane that are produced from the dual functional syngas conversion reactor to form valuable high octane gasoline range alkylate. This alkylate can be combined with the high octane aromatic gasoline made from the dual functional syngas conversion reactor to produce a high octane gasoline blend component. The high octane gasoline blend component preferably comprises a $C_5$–$C_{10}$ range material including greater than 10% aromatics and greater than 10% dimethyl iso-paraffins.

Alkylation is a conventional process which is well-known in the art. During alkylation, an iso-paraffin or mixture of iso-paraffins are contacted with one or more olefins in the presence of an acidic catalyst. Iso-butane is useful as the iso-paraffin for alkylation processes, but iso-pentane can also be used either by itself or as a mixture with iso-butane. Propylene, butenes, but also possibly pentene are useful sources of olefin. The most frequently used acid catalysts are sulfuric and hydrofluoric acids in the liquid form.

The pressure of the alkylation reaction using these liquid acids is sufficient to keep the olefins and iso-paraffin in the liquid phase at reaction temperature. The reaction is exothermic, and inlet temperature are near to ambient conditions. Internal cooling is commonly used to remove the heat of reaction. Sulfuric acid alkylation plants typically operate at between 45° and 55° F. and use a refrigeration system to control the heat of reaction. Hydrofluoric acid plants typically operate at between 90° and 100° F. using cooling water to control the heat of reaction. The molar ratio of iso-paraffin to olefin is always greater than 1.0 in order to avoid polymerization. In general the typical molar ratios are above 4 and most typically between 4 and 12. With sulfuric acid as the alkylation catalyst, the most typical ratios are between 5 an 10, and with hydrofluoric acid, the most typical ratios are between 8 and 12. Contact times in the mixer are in excess of 1 minute but typically less than 1 hour, e.g. 10–40 minutes.

After the reaction, the hydrocarbon phase comprising the alkylation product, unreacted iso-butane and lesser amounts of unreacted olefin is separated from the acid phase by density difference. The acid is recycled to the reactor, and can be cooled during this recycle operation. The hydrocarbon products are separated by distillation to recover the high boiling high octane highly branched iso-paraffinic product and unreacted iso-butane. The unreacted iso-butane is recycled to the reactor. Both catalysts will react with water in the feedstock to become diluted. With sulfuric acid, no special precautions need to be taken except for a coalescer to separate entrained water from the feed. With hydrofluoric acid, the feedstock is dried by passage over an adsorbent (typically a zeolite) to reduce the water content to low values (typically below 50 ppm, preferably below 10 ppm).

U.S. Pat. No. 6,137,021, issued Oct. 24, 2000 and U.S. Pat. No. 6,194,625, issued Feb. 27, 2001 describe such processes and are incorporated herein by reference. Alkylation processes are also described in, for example: "Saga of a Discovery: Alkylation", Herman Pines, Chemtech, March 1982 pages 150–154; "The Mechanism of Alkylation of Paraffins", Louis Schmerling, Industrial and Engineering Chemistry, February 1946, pages 275–281; "The Alkylation of Iso-Paraffins by Olefins in the Presence of Hydrogen Fluoride", Carl B. Linn and Aristid V. Grosse, American Chemical Society, Cleveland Meeting, Apr. 2–7, 1944; and "H2SO4, HF processes compared, and new technologies revealed", Lyle Albright, Oil and Gas Journal, Nov. 26, 1990.

It is desirable that the oxygen content of the feed to the alkylation process be limited to 4000 ppm oxygen, preferably less than 2500 ppm oxygen, and most preferably less than 1000 ppm oxygen. Oxygenates can come from the C3–C4 olefin product from FT reactor, but not from the iso-butane product from Isosynthesis reactor. The oxygen content of the feed to the alkylation reactor may be controlled by, for example, distillation of the FT olefin product to avoid inclusion of oxygenates, and/or water washing the olefin stream from the Fischer-Tropsch.

In a preferred embodiment, the process of the present invention includes processing, by conventional methods, the second hydrocarbonaceous product into at least one, and more preferably more than one, of the following products: jet fuel, diesel fuel, other distillate fuels, lube base stock, and lube base feed stock.

FIG. 1 illustrates one preferred embodiment of the process of the present invention. Synthesis gas 10 with a hydrogen to carbon molar ratio of 1.50 is provided by reforming of natural gas by use of oxygen and steam. The synthesis gas 10 is compressed to 50 atmospheres, heated to 400° C., and passed over a dual functional synthesis gas conversion catalyst in a reaction zone or reactor 12 to produce a first effluent 14. The dual functional synthesis gas conversion catalyst contains zinc, chromium, and ZSM-5 zeolite, the ZSM-5 zeolite being in the acidic form. The gas rate is selected so that 40% of the carbon monoxide in the synthesis gas is converted in the dual functional syngas conversion reactor 12.

The first effluent 14 comprises a first hydrocarbonaceous product (including an aromatic rich product, iso-butane, and other light gases), unreacted syngas, carbon dioxide, and water. The first effluent is moved to a first separator 16 where the effluent is cooled and the liquids are condensed. Water 18 is separated from the other products in separator 16 by density difference. The unreacted synthesis gas 20 is removed from the separator 16 to be used in a Fischer-Tropsch process discussed below. The hydrocarbonaceous product 17 from the first separator 16 is sent to a second separator 22 (a distillation complex) where the hydrocarbonaceous product is fractionated to form a light gas fraction 24, an iso-butane-containing stream 26, and high octane aromatic gasoline blend component 28. The iso-butane-containing stream is used to alkylate olefins derived from the Fischer-Tropsch process discussed below.

The unreacted synthesis gas 20 from the dual functional syngas conversion reactor is reduced in pressure to 20 atmospheres, heated to 245° C., and fed to a slurry phase Fischer-Tropsch synthesis reactor or reaction zone 50 which contains a cobalt catalyst. Sixty percent of the remaining synthesis gas is converted in this reactor. The Fischer-Tropsch synthesis process produces a second effluent 52 comprising water, a second hydrocarbonaceous product, and unreacted synthesis gas 58. The second effluent is passed to a first separator 54 where the water 56 is separated by density difference and at least a portion of the unreacted synthesis gas 58 is separated and recycled to the Fischer-Tropsch reactor. The second hydrocarbonaceous product from the first separator is sent to a second separator 62 (a distillation complex) where it is fractionated to form a light gas stream 64, a $C_3$–$C_4$ olefin-containing stream 66 containing less than 4000 ppm oxygen, preferably less than 2500 ppm oxygen, and most preferably less than 1000 ppm oxygen, and a higher boiling (i.e., $C_5^+$) stream 68. Stream 68 may contain some $C_{3+}$ alcohols that will boil in the $C_5^+$ hydrocarbon range. The higher boiling stream is subsequently upgraded to form salable naphtha, distillate fuels, and/or lube blend stocks.

The $C_3$–$C_4$ olefin-containing stream is then mixed with the iso-butane-containing stream 26 from the dual functional syngas conversion reactor to produce a composite stream 72, which is subjected to alkylation over sulfuric acid at about 20° C. in a liquid-liquid contacting alkylation reactor 74 with a residence time of 30 minutes followed by phase separation. Although not shown in FIG. 1, excess iso-butane is recycled to maintain a molar ratio of iso-butane to olefin in the alkylation reactor of 5:1. A high octane highly branched iso-paraffinic alkylate 76 is obtained from the alkylation and then mixed with the high octane aromatic gasoline blend component 28 from the dual functional syngas conversion reactor to form a high octane gasoline blend component 78 containing aromatics and highly branched iso-paraffins.

While the invention has been described in detail and with reference to specific embodiments thereof, it will be apparent to one skilled in the art that various changes and modifications can be made without departing from the spirit and scope of the invention.

That which is claimed is:

1. A process for converting synthesis gas into hydrocarbonaceous products, the process comprising the steps of:

a) subjecting a first portion of synthesis gas to a dual functional syngas conversion process to form a first effluent comprising a first hydrocarbonaceous product including aromatics and iso-paraffins and unreacted syngas;

b) subjecting a second portion of synthesis gas comprising at least a portion of the unreacted synges to a Fischer- Tropsch synthesis process to form a second effluent comprising a second hydrocarbonaceous product including linear paraffins and linear olefins; and c) alkylating the linear olefins with the iso-paraffins to produce high octane gasoline range alkylate.

2. The process of claim 1 wherein the iso-paraffins of the first hydrocarbonaceous product include iso-butane.

3. The process of claim 1 wherein the first hydrocarbonaceous product includes high octane aromatic gasoline.

4. The process of claim 1 wherein the linear olefins of the second hydrocarbonaceous product are olefins in the range of $C_3$–$C_5$.

5. The process of claim 1 wherein the second hydrocarbonaceous product includes linear alcohol, linear acid, and naphtha.

6. The process of claim 1 wherein the second hydrocarbonaceous product includes a $C_{10+}$ range material comprising greater than 70% paraffins.

7. The process of claim 1 wherein the first portion of synthesis gas and at least a portion of the second portion of synthesis gas axe derived from a common source of synthesis gas.

8. The process of claim 1 wherein the first portion of synthesis gas and at least a portion of the second portion of synthesis gas are derived from different sources of synthesis gas.

9. The process of claim 1 further comprising separating the unreacted portion of the synthesis gas from the first effluent before step (b).

10. The process of claim 1 further comprising processing the second hydrocarbonaceous product into at least one of jet fuel, diesel fuel, other distillate fuel, lube base stock, or lube base feed stock.

11. The process of claim 3 wherein the high octane aromatic gasoline and the high octane gasoline range alkylate are mixed to produce a high octane gasoline blend component.

12. The process of claim 11 wherein the high octane gasoline blend component comprises a $C_5$–$C_{10}$ range material including greater than 10% aromatics and greater than 10% dimethyl iso-paraffins.

13. The process of claim 11 further comprising processing the second hydrocarbonaceous product into at least one of jet fuel, diesel fuel, other distillate fuel, lube base stock, or lube base feed stock.

14. A process for converting synthesis gas into hydrocarbonaceous products, the process comprising the steps of:

a) providing a synthesis gas;

b) subjecting at least a portion of the synthesis gas to a dual functional syngas conversion process to form a first effluent comprising unreacted synthesis gas and a first hydrocarbonaceous product including aromatics and iso-paraffins;

c) subjecting the unreacted synthesis gas to a Fischer-Tropsch synthesis process to form a second effluent comprising a second hydrocarbonaceous product including linear paraffins and linear olefins; and d) alkylating the linear olefins with at least a portion of the iso-paraffins to produce high octane gasoline range alkylate.

15. The process of claim 14 wherein the iso-paraffins of the first hydrocarbonaceous product include iso-butane.

16. The process of claim 14 wherein the first hydrocarbonaceous product includes high octane aromatic gasoline.

17. The process of claim 14 wherein the linear olefins of the second hydrocarbonaceous product are olefins in the range of $C_3$–$C_5$.

18. The process of claim 14 wherein the second hydrocarbonaceous product includes linear alcohol, linear acid, and naphtha.

19. The process of claim 14 wherein the second hydrocarbonaceous product includes a $C_{10+}$ range material comprising greater than 70% paraffins.

20. The process of claim 14 wherein the step of providing a synthesis gas comprises producing a synthesis gas from methane, light hydrocarbons, coal, petroleum products, or combinations thereof.

21. The process of claim 14 further comprising separating the unreacted portion of the synthesis gas from the first effluent before step (c).

22. The process of claim 14 further comprising processing the second hydrocarbonaceous product into at least one of jet fuel, diesel fuel, other distillate fuel, lube base stock, or lube base feed stock.

23. The process of claim 16 wherein the high octane aromatic gasoline and the high octane gasoline range alkylate are mixed to produce a high octane gasoline blend component.

24. The process of claim 23 wherein the high octane gasoline blend component comprises a $C_5$–$C_{10}$ range material including greater than 10% aromatics and greater than 10% dimethyl iso-paraffins.

25. The process of claim 23 further comprising processing the second hydrocarbonaceous product into at least one of jet fuel, diesel fuel, other distillate fuels, lube base stock, or lube base feed stock.

26. The process of claim 14 wherein the dual functional syngas conversion process occurs at a higher pressure than the Fischer-Tropsch synthesis process.

27. The process of claim 14 wherein the dual functional syngas conversion process occurs at a higher temperature than the Fischer-Tropsch synthesis process.

28. The process of claim 25 further comprising separating the unreacted portion of the synthesis gas from the first effluent before step (c), and wherein:

a) the iso-paraffins of the first hydrocarbonaceous product include iso-butane;

b) the linear olefins of the second hydrocarbonaceous product are olefins in the range of $C_3$–$C_5$;

c) the second hydrocarbonaceous product includes linear alcohol, linear acid, and naphtha;

d) the second hydrocarbonaceous product includes a $C_{10+}$ range material comprising greater than 70% paraffins; and e) the high octane gasoline blend component comprises a $C_5$–$C_{10}$ range material including greater than 10% aromatics and greater than 10% dimethyl iso-paraffins.

29. A process for converting synthesis gas into hydrocarbonaceous products, the process comprising the steps of:

a) providing a synthesis gas;

b) subjecting at least a portion of the synthesis gas to a dual functional syngas conversion process to form a first effluent comprising a first portion of unreacted synthesis gas, carbon dioxide, a first portion of water, and a first hydrocarbonaceous product including aromatics and iso-butane;

c) separating the first hydrocarbonaceous product into a light gas fraction, an iso-butane-containing stream, and a high octane aromatic gasoline blend component;

d) subjecting the unreacted synthesis gas to a Fischer-Tropsch synthesis process to form a second effluent comprising a second portion of water, a second portion of unreacted synthesis gas, and a second hydrocarbonaceous product including linear paraffins and linear olefins;

e) separating the second hydrocarbonaceous product into a light gas stream, a $C_3$–$C_4$ olefin-containing stream, and a $C_5^+$ stream;

f) alkylating the olefin-containing stream with the iso-butane-containing stream, wherein the oxygen content of the feed to the alkylation reactor is below 4000 ppm, to produce high octane iso-paraffinic gasoline range alkylate.

30. The process of claim 29 wherein the dual functional syngas conversion process is conducted with the first portion of the synthesis gas having a pressure of 50 atmospheres and a temperature of 400° C. and using a dual functional synthesis gas conversation catalyst comprising zinc, chromium, and ZSM-5 zeolite in an acidic form.

31. The process of claim 29 wherein the Fischer-Tropsch synthesis process is conducted with the second portion of the synthesis gas having a pressure of 20 atmospheres and a temperature of 245° C. and using a Fischer-Tropsch synthesis catalyst comprising a cobalt catalyst.

32. The process of claim 30 wherein the Fischer-Tropsch synthesis process is conducted with the second portion of the synthesis gas having a pressure of 20 atmospheres and a temperature of 245° C. and using a Fischer-Tropsch synthesis catalyst comprising a cobalt catalyst.

33. The process of claim 29 wherein the $C_5^+$ stream is upgraded to form at least one of the group consisting of naphtha, distillate fuel, and lube blend stock.

34. The process of claim 29 wherein the high octane aromatic gasoline blend component is mixed with the high octane iso-paraffinic gasoline range alkylate to produce a high octane gasoline blend $C_5$+ component containing aromatics and highly branched iso-paraffins.

35. The process of claim 33 wherein the high octane aromatic gasoline blend component is mixed with the high octane iso-paraffinic gasoline range alkylate to produce a high octane gasoline blend component containing aromatics and highly branched iso-paraffins.

36. The process of claim 32 wherein the alkylation of step (f) is conducted at 20° C. over sulfuric acid.

37. The process of claim 29 further comprising separating the carbon dioxide and the first portion of unreacted syngas from the first effluent before separating the first hydrocarbonaceous product and separating the second portion of water and the second portion of unreacted syngas from the second effluent before separating the second hydrocarbonaceous product.

38. The process of claim 37 wherein:

the dual functional syngas conversion process is conducted with the first portion of the synthesis gas having a pressure of 50 atmospheres and a temperature of 400° C. and using a dual functional synthesis gas conversation catalyst comprising zinc, chromium, and ZSM-5 zeolite in an acidic form;

the Fischer-Tropsch synthesis process is conducted with the second portion of the synthesis gas having a pressure of 20 atmospheres and a temperature of 245° C. and using a Fischer-Tropsch synthesis catalyst comprising a cobalt catalyst;

the alkylation of step (f) is conducted at 20° C. over sulfuric acid;

the $C_{5+}$ stream is upgraded to form at least one of the group consisting of naphtha, distillate fuel, and lube blend stock; and the high octane aromatic gasoline blend component is mixed with the high octane iso-paraffinic gasoline range alkylate to produce a high octane gasoline blend component containing aromatics and highly branched iso-paraffins.

* * * * *